US006901640B2

(12) United States Patent
Sevey

(10) Patent No.: US 6,901,640 B2
(45) Date of Patent: Jun. 7, 2005

(54) SEALED LINER SYSTEM FOR INTERMENT VESSELS OR CONTAINERS

(75) Inventor: Douglas L. Sevey, Waterloo, IA (US)

(73) Assignee: Affinity Corporation, Waterloo, IA (US)

( * ) Notice: Subject to any disclaimer, the term of this patent is extended or adjusted under 35 U.S.C. 154(b) by 0 days.

(21) Appl. No.: 10/108,808

(22) Filed: Mar. 28, 2002

(65) Prior Publication Data

US 2003/0182779 A1 Oct. 2, 2003

(51) Int. Cl.[7] ..... A61G 17/00

(52) U.S. Cl. ..... 27/35; 27/19; 52/133; 52/135; 52/139

(58) Field of Search ..... 27/19, 35; 52/128, 52/133, 139, 135

(56) References Cited

U.S. PATENT DOCUMENTS

| | | | |
|---|---|---|---|
| 188,014 | A | 3/1877 | Holmes |
| 692,067 | A | 1/1902 | Okey |
| 1,014,614 | A | 1/1912 | St. Clair |
| 1,818,485 | A | 8/1931 | Lambert |
| 2,527,464 | A | 10/1950 | Titmus |
| 2,655,714 | A | 10/1953 | Rench |
| 2,783,523 | A | 3/1957 | Halley |
| 2,806,278 | A | 9/1957 | Crump |
| 2,835,955 | A | 5/1958 | Snyder |
| 2,848,780 | A | 8/1958 | Gosnell |
| 2,940,156 | A | 6/1960 | Cook |
| 2,974,390 | A | 3/1961 | Nelson |
| 3,038,232 | A | 6/1962 | Wean |
| 3,159,901 | A | 12/1964 | Harrington et al. |
| 3,164,880 | A | 1/1965 | Hotchkiss |
| 3,172,183 | A | 3/1965 | Bugg |
| 3,208,186 | A | 9/1965 | Fulton et al. |
| 3,230,674 | A | 1/1966 | Christensen |
| 3,283,386 | A | 11/1966 | Cenegy |
| 3,295,179 | A | 1/1967 | Behrendt |
| 3,383,260 | A | 5/1968 | Mojonnier |
| 3,406,229 | A | 10/1968 | Cenegy |
| 3,411,191 | A | 11/1968 | Ikert et al. |
| 3,439,461 | A | 4/1969 | Chandler et al. |
| 3,464,171 | A | 9/1969 | Chandler et al. |
| 3,541,747 | A | 11/1970 | Olson et al. |
| 3,545,055 | A | 12/1970 | Pare |
| 3,839,768 | A | 10/1974 | McQuestion |
| 3,868,799 | A | 3/1975 | Hayward |
| 3,945,094 | A | 3/1976 | Daran et al. |
| 3,964,140 | A | 6/1976 | Gauchard |
| 4,044,435 | A | 8/1977 | Acton |
| RE29,532 | E | 2/1978 | Zwick |
| 4,143,494 | A | 3/1979 | Abbate |

(Continued)

FOREIGN PATENT DOCUMENTS

| | | |
|---|---|---|
| BE | 562957 | 12/1957 |
| GB | 574657 | 1/1946 |
| GB | 1488999 | 10/1977 |
| WO | WO 01/62200 | 8/2001 |

*Primary Examiner*—William L. Miller
(74) *Attorney, Agent, or Firm*—Boyle, Fredrickson, Newholm, Stein & Gratz, S.C.

(57) ABSTRACT

An interment container includes upper and lower members that define an internal cavity. The remains of a deceased are placed within a liner adapted to be positioned within the internal cavity. The liner is peripherally sealed about the remains of the deceased, to prevent leakage of fluids from within the liner and infiltration of fluids into the liner. The liner includes lower and upper sections that define facing peripheral flanges which are sealed together by positioning a heating member between facing surfaces of the flanges, and imparting heat to the heating member so as to liquefy the adjacent material of the flanges. The liquefied material flows together about the heating member and the heating member is then cooled, such that the liquefied portions of the flanges solidify to integrally seal the flanges together.

17 Claims, 3 Drawing Sheets

U.S. PATENT DOCUMENTS

| | | | | | |
|---|---|---|---|---|---|
| 4,154,031 | A | | 5/1979 | Williamson, Jr. | |
| 4,253,220 | A | | 3/1981 | Work | |
| 4,261,083 | A | | 4/1981 | Darby et al. | |
| 4,314,390 | A | | 2/1982 | Darby et al. | |
| 4,328,606 | A | | 5/1982 | Nunes | |
| 4,337,445 | A | | 6/1982 | Akagiri | |
| 4,337,556 | A | * | 7/1982 | Winburn et al. | 27/2 |
| 4,351,091 | A | | 9/1982 | Goodkin | |
| 4,372,018 | A | * | 2/1983 | Miller et al. | 27/35 |
| 4,463,484 | A | | 8/1984 | Valle Arizpe | |
| 4,727,632 | A | | 3/1988 | Yearsley | |
| 4,743,320 | A | | 5/1988 | Shaw | |
| 4,759,105 | A | | 7/1988 | Buerosse | |
| 4,788,757 | A | * | 12/1988 | Bethune et al. | 27/2 |
| 4,800,631 | A | | 1/1989 | Pellmann | |
| 4,924,565 | A | * | 5/1990 | Rathjen | 27/7 |
| RE33,636 | E | | 7/1991 | Yearsley | |
| 5,121,529 | A | | 6/1992 | McClure | |
| 5,245,733 | A | | 9/1993 | Goria | |
| 5,321,873 | A | | 6/1994 | Goria | |
| 5,381,591 | A | | 1/1995 | Ponger et al. | |
| 5,404,627 | A | | 4/1995 | Shepherd | |
| 5,471,718 | A | | 12/1995 | Harrill | |
| 5,485,661 | A | | 1/1996 | McClure | |
| 5,548,880 | A | | 8/1996 | Harb | |
| 5,568,677 | A | | 10/1996 | Tobin | |
| 5,592,723 | A | | 1/1997 | Leijonhufvud et al. | |
| 5,611,125 | A | | 3/1997 | Williams et al. | |
| 5,722,133 | A | | 3/1998 | Farris et al. | |
| 5,870,862 | A | | 2/1999 | Gordon | |
| 5,960,524 | A | | 10/1999 | Darby et al. | |
| 6,170,201 | B1 | | 1/2001 | Mason et al. | |
| 6,453,626 | B1 | | 9/2002 | Weilein et al. | |

* cited by examiner

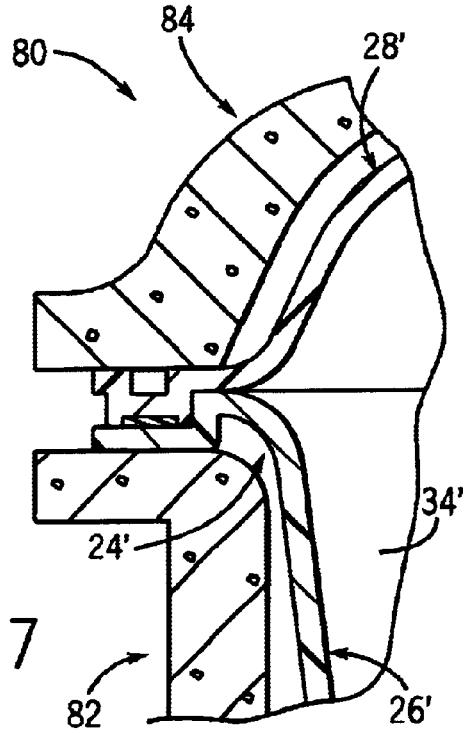
FIG. 7
FIG. 8
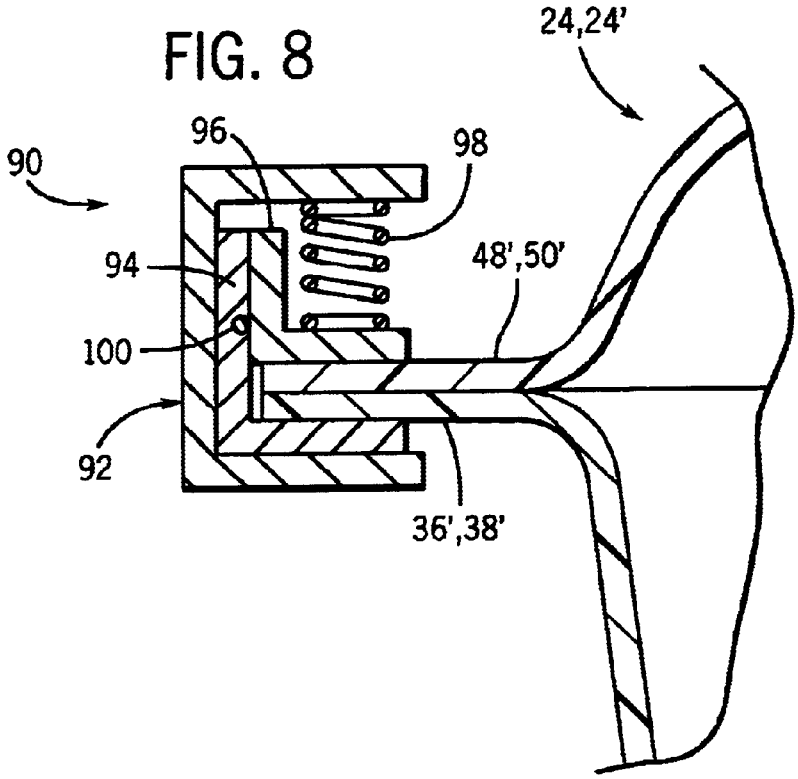

SEALED LINER SYSTEM FOR INTERMENT VESSELS OR CONTAINERS

BACKGROUND AND SUMMARY OF THE INVENTION

This invention relates to interment vessels or containers such as caskets or vaults, and more particularly to a system for sealing the interior of an interment vessel.

Interment vessels, such as caskets and vaults, present significant long-term problems caused by the inability to effectively seal the interior of the vessel against leakage and infiltration. In a conventional concrete vault, it is common to place an asphaltic sealing compound between the base and the lid of the vault. Over time, this type of seal inevitably breaks down. In addition, it is common for the concrete material of the vault to crack under pressure from the surrounding earth or due to freeze-thaw pressures. In either case, the integrity of the vault is compromised, which can result in infiltration of ground water and other fluids, as well as outward leakage of fluids and other materials from the decomposing contents of the vault. Such fluid infiltration and leakage can have serious adverse effects on ground water and other aspects of the surrounding environment.

Conventional caskets are typically not sealed at all, such that reliance is placed upon the vault seal in a burial interment application to prevent leakage and infiltration. In an above-ground interment application, the absence of a casket seal requires that the interment facility install and maintain a system for collecting and disposing of fluids that emanate from the caskets. These are serious drawbacks associated with conventional burial and interment vessels, that result in difficult problems which have either been ignored or which have involved troublesome and expensive solutions.

It is an object of the present invention to provide a system for sealing the interior of an interment vessel or container, which prevents leakage of fluids from the interior of the vessel or container and which prevents infiltration of fluids from the exterior of the vessel or container. It is a further object of the invention to provide such a system which is relatively simple in its components and construction, and which can be relatively easily carried out after the remains have been placed into the vessel or container. It is a further object of the invention to provide such a system having a sealing arrangement which ensures a positive, integral seal. It is a further object of the invention to provide a sealed interment container or vessel as well as a method of sealing the interior of an interment container or vessel, which is capable of being employed in combination with conventional interment containers or vessels, such as caskets or vaults.

In accordance with the general principle of the present invention, an interment vessel or container has an exterior shell and a sealed internal liner. The exterior shell is of two-piece construction, typically including a lower member or base and an upper member, e.g. a top or lid, which is adapted to overlie the lower member. In the case of a conventional burial vault, the lower member is in the form of the bottom section of the vault that defines a cavity or recess which is adapted to receive a casket, and the upper member is in the form of a concrete lid that engages the upper end of the base to form the closed interior of the vault. Similarly, in the case of a casket, the lower member or base is in the form of the bottom or lower section of the casket, which defines a recess or cavity adapted to receive the body of the deceased. The upper member is in the form of a top or lid that engages the upper end of the lower member, to form the closed interior of the casket. In either application, the invention contemplates a liner construction that is sealed about the contents of the vessel or container, to prevent outward leakage of fluids from within the vessel or container and inward infiltration of fluids into the vessel or container.

The liner is in the form of a lower section that defines a recess adapted to receive the vessel contents, and which is received within the recess or cavity defined by the lower member of the vessel. The liner further includes an upper section which overlies the lower section, and which is sealed to the lower section. The upper and lower sections of the liner cooperate to define an enclosed interior within which the vessel contents are contained.

In one embodiment, the lower section of the liner defines an upper flange, and the upper section of the liner defines a lower flange which is adapted to engage the upper flange of the lower member. The upper and lower sections are formed of a thermoplastic material, and the flanges are adapted to be sealed together to form a unitary flange that extends about the periphery of the liner. In a preferred form, the flanges are sealed together by means of a peripherally extending strip of electrically conductive and resistive material disposed between the upper and lower flanges. Electrical current is applied to the strip of material to heat the strip, which functions to heat the surrounding areas of the upper and lower flanges. The thermoplastic material of the upper and lower flanges liquefies and flows together about the strip to unite the upper and lower flanges, and the current applied to the strip is then cut off so that the strip and the material of the upper and lower flanges subsequently cools, which results in solidification of the liquefied material of the flanges. The upper and lower flanges are thus bonded or sealed together to form a unitary integral seal flange about the entire periphery of the liner. The integral sealed flanges function to prevent leakage of the contents of the liner and to prevent infiltration of fluids into the liner.

The thermoplastic material of the liner is capable of outward expansion so as to accommodate pressure which may be applied either from the interior due to gases given off during decomposition of the vessel contents, or from the exterior due to ground water or forces applied by the surrounding earth in the event of failure of the vessel.

In one form, the lower liner section is formed such that the upper flange of the lower liner section overlies an upper edge defined by the lower member of the vessel. Similarly, the lower flange of the upper liner section is formed to underlie the lower edge of the upper member of the vessel. In this manner, the liner does not interfere with or detract from the external aesthetic appearance of the vessel. This enables the liner to be utilized in combination with conventional interment caskets or vaults, regardless of the external vault or casket configuration or design.

The invention further contemplates a method of sealing an interment vessel such as a casket or a vault, as well as a sealed interment vessel construction and a liner system for use in providing a sealed interior for an interment vessel.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 7 is a section view somewhat similar to FIG. 5, showing the sealed liner system of the present invention utilized in combination with an interment vessel such as a concrete burial vault; and FIG. 8 is a partial section view showing an alternative system for sealing the upper and lower liner sections together to seal the interior of an interment vessel.

DETAILED DESCRIPTION OF THE INVENTION

Figure 1:
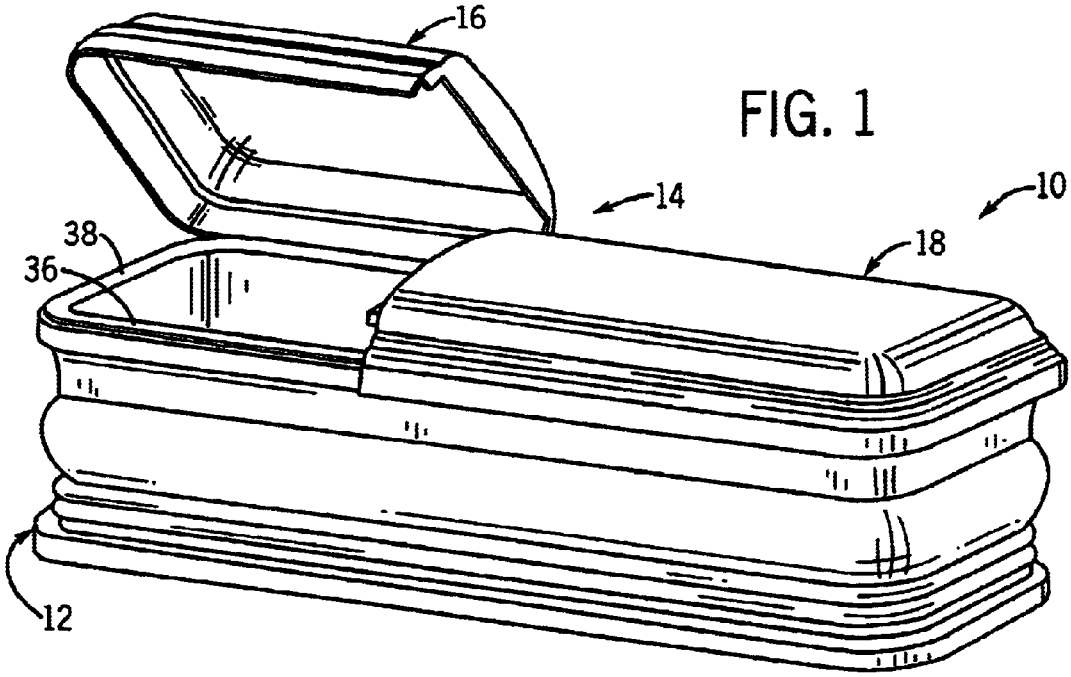
FIG. 1 is an isometric view of an interment vessel, representatively shown as a casket, including the lower section of the liner in accordance with the invention.

Referring to FIG. 1, an interment vessel or container in the form of a casket 10 generally includes a bottom or lower member 12 which defines a bottom wall and a series of upstanding side walls which cooperate to define an internal recess or cavity adapted to receive the remains of a deceased. Casket 10 further includes a top or upper member 14 which is adapted to overlie and enclose the recess or internal cavity of lower member 12. In the illustrated embodiment, upper member 14 has a split construction, and includes a head section 16 and a foot section 18, each of which is hinged to lower member 12 for providing pivoting movement between open and closed positions. It is understood, however, that upper member 14 may be of a one-piece construction as opposed to the illustrated split construction. It is further understood that upper member 14 may be separate from lower member 12 so as to be engageable with lower member 12 by placing the upper member on the lower member, or that upper member 14 may be engaged with lower member 12 in a manner other than via a hinge connection.

Because casket 10 is merely a representative environment for the present invention, it is understood that the details of the components and construction of casket 10 are illustrated schematically and that casket 10 may take any other satisfactory form. As illustrated, the components of casket 10 are shown as being formed of a single walled construction of a thermoplastic material. It is understood that the components of casket 10 may also have a double wall plastic construction, or may be formed of a material other than plastic, e.g. wood or metal, or a combination wood understructure with metal finish coating, or a sprayed metallic coating applied to a plastic or wood base, etc. In any type of construction, lower member 12 of casket 10 defines a peripheral upwardly facing edge surface 20 located outwardly of the internal cavity or recess, shown at 22, defined by lower member 12.

In accordance with the present invention, an inner container or liner, shown generally at 24, is located within the interior of casket 10. Liner 24 includes a lower section 26 and an upper section 28, which are adapted to be peripherally sealed together so as to provide an air-tight and fluid-tight sealed structure about the remains of the deceased contained within casket 10.

Figure 4:
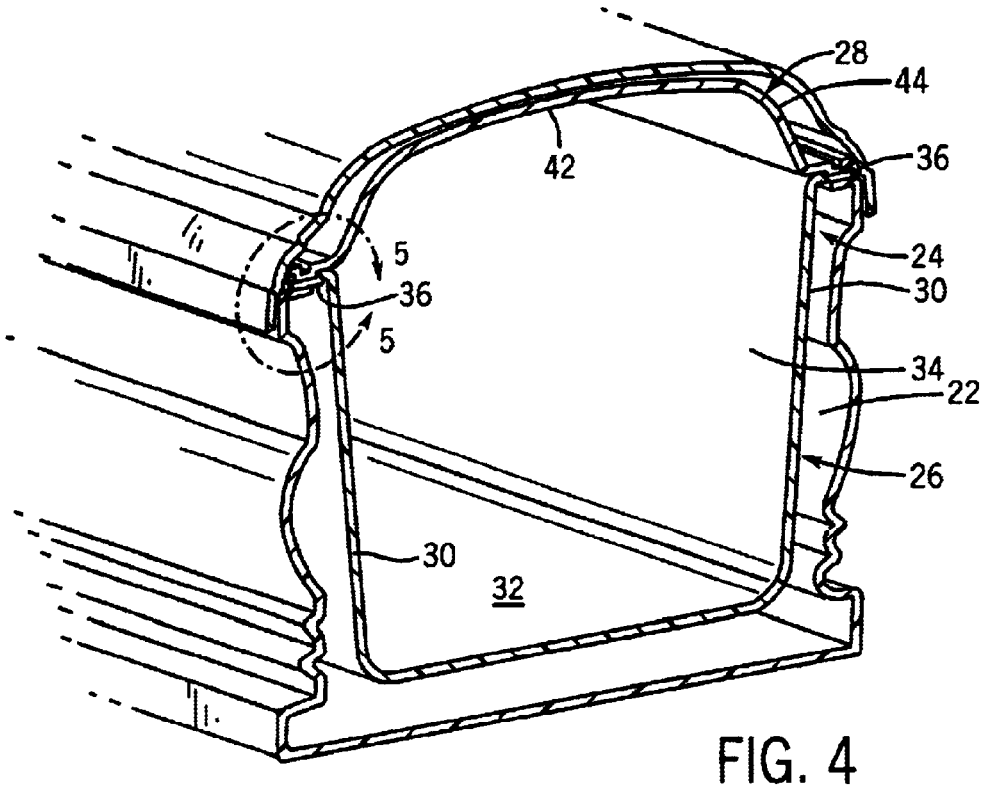
FIG. 4 is a transverse section view through the casket of FIGS. 1 and 2, with the upper and lower liner sections sealed together to seal the interior of the casket.
Figure 5:
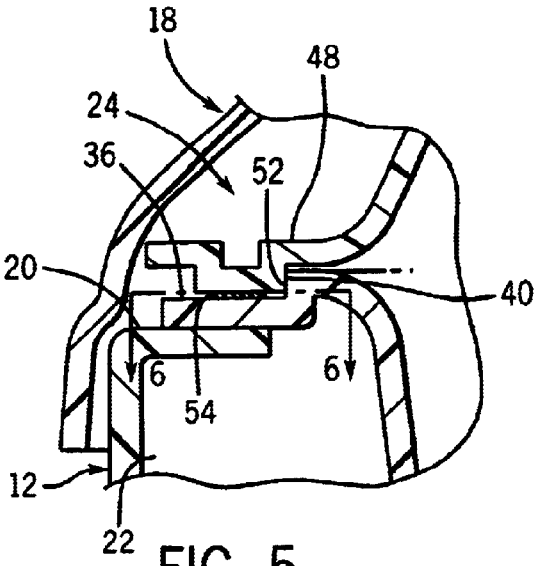
FIG. 5 is an enlarged partial section view with reference to line 5—5 of FIG. 4.
Figure 6:
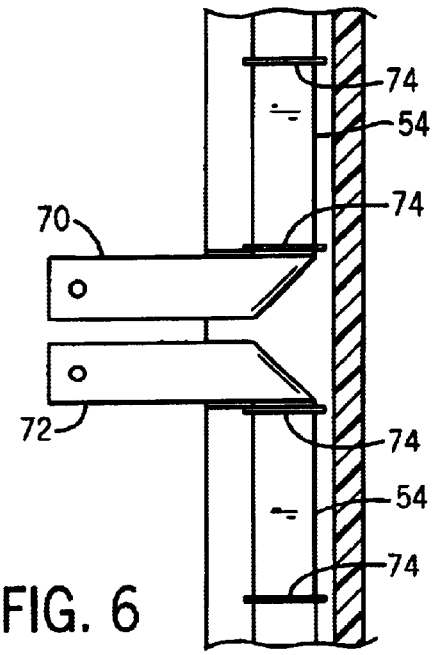
FIG. 6 is a partial section view with reference to line 6—6 of FIG. 5.

As shown in FIG. 4, lower section 26 includes a pair of side walls 30 which extend upwardly from a bottom wall 32. A pair of end walls extend upwardly from the ends of bottom wall 32 and between side walls 30, to define an inner cavity or recess 34 located within the cavity or recess 22 defined by casket lower member 12. In addition, liner lower section 26 includes an outwardly extending flange 36 at the upper end of each side wall 30. In a similar manner, each end wall of liner lower section 26 includes an outwardly extending flange 38 (FIG. 1). Side wall flanges 36 and end wall flanges 38 are coplanar and cooperate to define an outwardly extending flange structure that extends about the entire periphery of liner lower section 26.

In the illustrated embodiment, flanges 36, 38 rest on and are supported by the upwardly facing edge surface 20 of casket lower member 12, such that liner lower section 26 is suspended within the internal cavity or recess 22 defined by casket lower member 12. It is understood, however, that liner lower section 26 may be configured such that its bottom wall 32 rests on the bottom wall of casket lower member 12 so as to provide support from below for liner lower section 26 within internal cavity or recess 22 of casket lower member 12. It is also understood that liner flanges 36, 38 may be positioned other than in engagement with and supported by edge surface 20 of casket lower member 12.

Liner lower section 26 is formed so as to define a step 40 located inwardly of flanges 36, 38 at the upper ends of the end walls and side walls 30 of liner lower section 26.

Liner upper section 28 includes a top wall 42 in combination with depending side walls 44 and end walls 46. Outwardly extending side flanges 48 and end flanges 50 extend from side walls 44 and end walls 46, respectively. Liner upper section 28 is adapted to be placed over liner lower section 26 so as to enclose the inner cavity or recess 34 of liner lower section 26. While liner upper section 28 is shown as having a certain concave configuration, it is understood that liner upper section 28 may be formed with any other type of concave configuration, or may be formed flat or with a convex configuration. Side flanges 48 and end flanges 50 are coplanar and cooperate to define an outwardly extending flange structure that extends about the entire periphery of liner upper section 28.

Each side flange 48 and end flange 50 of liner upper section 28 includes a step 52 which is configured to cooperate with step 40 defined by flanges 36, 38 of liner lower section 26, so as to locate liner upper section 28 relative to lower section 26 when upper section 28 is placed on lower section 26. An electrically conductive and resistive sealing member, in the form of a sealing strip 54, is located between the upwardly facing surface of liner lower section flanges 36, 38 and the downwardly facing surfaces of liner upper section flanges 48, 50. Sealing strip 54 may be formed of a metallic material such as ¼"×0.009 nickel chrome wire, although it is understood that other satisfactory materials may be employed. In a manner to be explained, sealing strip 54 is utilized to seal liner lower section 26 and upper section 28 together.

Figure 2:
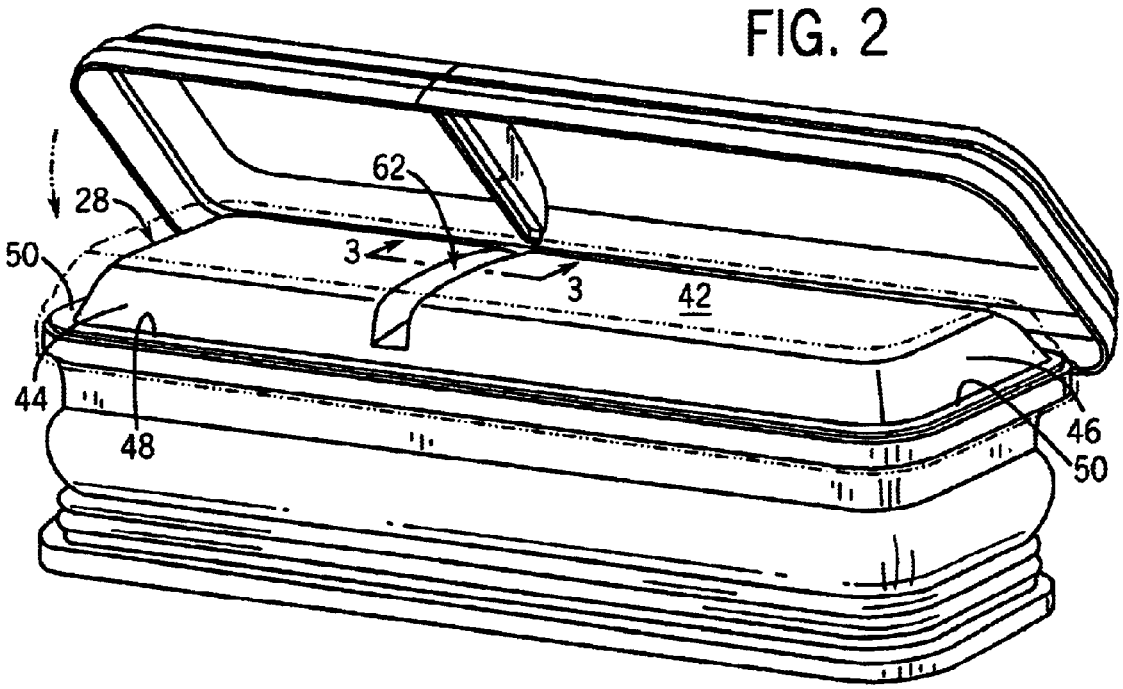
FIG. 2 is a view similar to FIG. 1, showing the upper section of the liner overlying the lower section of the liner, for providing a sealed interior for the casket in accordance with the present invention.
Figure 3:
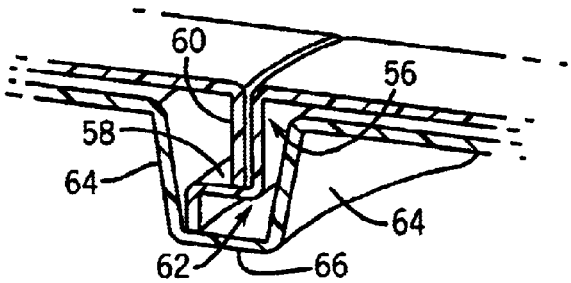
FIG. 3 is a partial section view taken along line 3—3 of FIG. 2.

As shown in FIGS. 1—3, foot section 18 of casket upper member 14 includes a transverse end wall 56, which is formed with a lateral step 58. Head section 16 of casket upper member 14 defines an end wall 60 which is adapted to be located adjacent foot section end wall 56 when head section 16 and foot section 18 are closed, and which may be configured such that its lower edge rests on step 58. A transverse groove or trough 62 is formed in liner upper section 28 for receiving foot section end wall 56 and head section end wall 60. Trough 62 is defined by spaced apart trough side walls 64 and a trough bottom wall 66, which are formed integrally with upper section top wall 42 and side walls 44.

Lower section 26 and upper section 28 of liner 24 are preferably formed of a thermoplastic material in a rotational or injection molding process. Representatively, the material of liner sections 26, 28 may be a thermoplastic material such as polyethylene, although it is understood that any other satisfactory material may be employed.

In operation, liner 24 functions as follows to provide a sealed internal cavity within casket 10. Initially, liner lower section 26 is placed within internal cavity or recess 22 of casket lower member 12, as shown in FIG. 1. Casket 10 is then utilized in a conventional manner prior to interment, such that the body of a deceased is placed into the upwardly facing recess or cavity 34 of liner lower section 26, and is arranged in a conventional manner. In the illustrated embodiment, foot section 18 of casket upper member 14 can then be closed and head section 16 left open, to reveal the upper portion of the body in the event of an open-casket visitation or funeral. Typically, a fabric inner liner is located within the interior of the recess 34 of lower section 26, in the same manner as is conventional in connection with a casket that does not contain liner lower section 26. Such a fabric liner typically overlies the exposed casket upper edges, such that the presence of lower liner section 26 is concealed.

Prior to interment, head section 16 and foot section 18 of casket upper member 14 are opened or removed so as to expose the internal cavity 34 of liner lower section 26. Liner upper section 28 is then placed over and engaged with liner lower section 26 as shown and described, such that side flanges 48, 50 of liner upper section 28 are placed on and supported by side flanges 36, 38 of liner lower section 26, with strip 54 located between the facing flange surfaces. The mating flange steps, such as 40, 52, function to ensure that liner upper section 28 is properly positioned on liner lower section 26. Sealing strip 54 is located on the upwardly facing surfaces of lower section side and end flanges 36, 38 and is in contact therewith, and upper section side and end flanges 48, 50 are configured such that the respective downwardly facing surfaces rest on the upper surface of sealing strip 54.

Sealing strip 54 extends about the entire periphery of liner lower section 26, and includes first and second end sections 70, 72 that are folded relative to the remainder of sealing strip 54 and extend outwardly to the exterior of liner 24 past the side edges of the liner section flanges. The space between end sections 70, 72 is very small but is sufficient to ensure that end sections 70, 72 remain out of contact. A series of retainers, which may be in the form of staples 74, overlie sealing strip 54 at spaced locations and extend into lower flanges 36, 38, to retain sealing strip 54 in place.

Once upper liner section 28 has been positioned over lower liner section 26 as described, an electrical current is applied to sealing strip 54 through end sections 70, 72. In its simplest form, the electrical current can be applied by connecting each conductor of a two-conductor cord to one of end sections 70, 72 using openings formed in end sections 70, 72. The cord is then plugged into a conventional wall outlet, to supply an electrical current to strip 74. The resistance of strip 54 functions to heat strip 54 when electrical current is applied in this manner, and strip 54 is heated to a degree sufficient to liquefy the thermoplastic material of flanges 36, 38 and 48, 50 that are in contact with strip 54, as well as the adjacent portions of flanges 36, 38 and 48, 50. The liquefaction of the material of flanges 36, 38 and 48, 50 causes such material to flow together about sealing strip 54, to surround and encase sealing strip 54 about the periphery of liner 24. Representatively, an electrical current of 20 amps is applied to sealing strip 54 for approximately 5 minutes, to elevate the temperature of sealing strip 54 to a temperature of approximately 450° F. This is sufficient to liquefy the material of flanges 36, 38 and 48, 50 for a duration sufficient to cause the material of flanges 36, 38 and 48, 50 to flow together about sealing strip 54. Thereafter, the electrical current is removed from sealing strip 54, such that sealing strip 54 and the surrounding areas of flanges 36, 38 and 48, 50 return to ambient temperature, to solidify the previously liquefied material of flanges 36, 38 and 48, 50. This functions to form flanges 36, 38 and 48, 50 integrally together, with the solidified material encapsulating sealing strip 54 functioning to form an integral air-tight and fluid-tight peripheral seal about liner 24 between flanges 36, 38 and 48, 50, respectively.

Preferably, pressure is applied during heating of flanges 36, 38 and 48, 50 in order to ensure that a proper seal is formed upon heating of strip 54. Such pressure may be applied using clamp-type tools such as locking pliers spaced about the periphery of liner 24, which are preferably designed so as to provide pressure along a predetermined length or segment of the flanges 36, 38 and 48, 50. Alternatively, a specialized clamping tool may be employed to fit about the periphery of liner 24 so as to clamp flanges 36, 38 and 48, 50 together.

After liner upper section 28 is sealed to liner lower section 26 in this manner, upper member 14 of casket 10 is placed over liner upper section 28 and casket lower member 12, as shown in FIGS. 3 and 4. When both head section 16 and foot section 18 of upper member 14 are in the closed position, head section end wall 60 and foot section end wall 56 are received within trough 62 formed in upper liner section 28. In this manner, upper liner section 28 does not interfere with the structure of casket upper member 14, and allows upper member 14 to be closed in a conventional manner so as to conceal the presence of liner 24. As shown, both head section 16 and foot section 18 of upper member 14 include a depending side wall which extends downwardly past upwardly facing edge surface 20 of lower member 12 when head section 16 and foot section 18 are closed, such that the liner 24 is concealed and does not detract from the overall aesthetic appearance of casket 10.

Prior to closing casket upper member 14, end sections 70, 72 of sealing strip 54 are either cut off or bent downwardly at the location where end sections 70, 72 extend outwardly of flanges 36, 38 and 48, 50, since flange send sections 70, 72 would otherwise interfere with closing of upper member 14.

Subsequent to sealing of liner 24 and closing casket upper member 14, casket 10 is fully prepared for interment, which typically involves above-ground interment in a mausoleum or crypt, or below-ground interment in a burial vault. In either method of interment, liner 24 is operable to prevent leakage of fluids to the exterior of casket 10, which otherwise may occur upon decomposition of the casket contents. In addition, the seal between liner lower section 26 and upper section 28 is sufficient to withstand pressure generated during such decomposition. Further, the walls of liner 24 are capable of flexing outwardly in response to the buildup of pressure within the interior of liner 24 caused by decomposition of the remains contained within liner 24, to alleviate stresses which may otherwise be experienced by the seal between liner lower section 26 and upper section 28. Liner 24 is constructed such that a peripheral space or gap is located between the outer surfaces of liner 24 and the facing inner surfaces of casket lower member 12 and upper member 14, to allow for expansion of the walls of liner 24. The odors typically associated with above-ground interment are thus eliminated, as is the need for expensive and maintenance-intensive drainage systems which are often required for such interment facilities.

In a below-ground interment, the seal between lower section 26 and upper section 28 of liner 24 is also operable to prevent infiltration of ground water or other fluids into the interior of liner 24, which may result during flooding or other extremely wet conditions. This functions to prevent the leakage of contaminated groundwater out of casket 10, to preserve the integrity of the ground water supply.

FIG. 7 illustrates an alternative sealed interment vessel or container which is within the scope of the present invention. In this application, a liner 24' is adapted to be used in combination with an outer interment vessel or container, which is in the form of a vault that is adapted to be buried. The vault, shown at 80, defines an internal cavity 81 within which a casket is adapted to be placed. Vault 80 includes a base 82 and a top 84 which is adapted to be placed over base 82, and which cooperate to define internal cavity 81. In a conventional manner, base 82 and top 84 are formed of concrete or other cementious material, although it is understood that other materials may be employed. Base 82 and top 84 of vault 80 are of conventional construction, and liner 24' can be employed in combination with base 82 and top 84 to form a sealed, fluid-tight internal cavity within vault 80.

Liner 24' has a lower section 26' and an upper section 28', which are generally constructed similarly to lower section 26 and upper section 28, as described previously. In this application, however, the side walls and end walls of lower section 26' and upper section 28' are configured so as to correspond to the shape of the cavity or recess defined by the inner surfaces of base 82 and top 84.

Liner lower section 26' is placed into the internal cavity or recess defined by vault base 82, and a conventional casket is placed into the interior of liner lower section 26'. Alternatively, a sealed casket as described previously may be employed, to provide a double sealed interment for the remains of a deceased. Liner upper section 28' is then placed over and engaged with liner lower section 26', and is sealed thereto in the same manner as described previously. The vault top 84 is then placed over liner upper section 28' as shown. If desired, a sealing compound may be applied to the gap between the facing surfaces of base 82 and top 84 outwardly of the space occupied by the flanges of liner lower section 26' and upper section 28'. Alternatively, vault top 84 may be formed with a downwardly extending peripheral lip or vault base 82 may be formed with an upwardly extending peripheral lip, located outwardly of the flanges of liner 24' so as to conceal the flange edges and to provide a barrier for water infiltration into the space between liner 24' and the interior walls of vault 80.

FIG. 8 illustrates an alternative system for sealing the liner flanges together, which eliminates the use of sealing strip 54. In this embodiment, a sealing tool 90 is applied to the liner flanges, which have a modified substantially planar construction shown at 36', 38' and 48', 50'. Sealing tool 90 includes a C-shaped frame 92 which contains a stationary lower L-shaped anvil 94. A clamp member 96 is movably mounted within frame 92 relative to anvil 94, and a spring 98 bears between the upper leg of frame 92 and the horizontal leg of clamp member 96, for urging clamp member 96 toward the facing horizontal leg of anvil 94. A heating wire 100 is located within a recess defined by the vertical leg of anvil 94 and is arranged to impart heat to both anvil 94 and to clamp member 96. With this construction, heat from anvil 94 and clamp member 96 is transferred to flanges 36', 38' and 48', 50', to liquefy the flange material. Spring 98 functions to apply pressure to flanges 36', 38' and 48', 50', to cause the liquefied material thereof to flow together. Subsequent cooling of the previously liquefied material of flanges 36', 38' and 48', 50' causes the outer flange areas to be integrally formed together, to provide a fluid-tight seal to the interior of liner 24'.

A sealing arrangement of the type illustrated in FIG. 8 is shown and described in copending U.S. application Ser. No. 09/513,537 filed Feb. 25, 2000, the disclosure of which is hereby incorporated by reference.

While the invention has been shown and described with respect to specific embodiments, it is understood that various alternatives are contemplated as being within the scope of the present invention. The following are illustrative of modifications or alterations which may be made, and are neither limitative or exhaustive. Casket 10 and burial vault 80 are shown as the type of interment containers which are typically intended for use in interment of human remains. It is understood that such components may be differently shaped and sized so as to accommodate animal remains as well. While liner lower flanges 36, 38 are shown as resting on the upper edge of the lower casket or vault section, it is also understood that the liner flanges may be supported by some other inwardly extending structure associated with the vault or casket, which need not be the upper edge of the lower vault or casket section. It is also understood that while the liner lower wall, such as 32, has been shown as being spaced above the casket lower wall, support for the lower liner section may be provided by the liner lower wall resting on the bottom wall of the casket or vault. While casket 10 has been illustrated as having a two-piece upper member, it is also understood that a single-piece upper member may be employed. Liner upper section 28 having trough 62 may also be used with this type of casket, although the presence of trough 62 is unnecessary. While sealing strip 54 is shown for providing an internal flange seal forming mechanism and sealing tool 90 is shown for forming the flange seal from the exterior, it is understood that other types of internal or external seal forming mechanisms may be employed. For example, sealing strip 54 may be replaced with a peripheral tubular member, which is adapted to receive a heated fluid or other heating medium when it is desired to seal the flanges together. Alternatively, a chemical bonding agent such as cyanoacrylate or methacrylates may be applied between the liner flanges to form the liner flanges together. Similarly, other types of external sealing mechanisms may be utilized to apply heat and pressure to the flanges from the exterior, to seal the flanges together.

Various other alternatives and embodiments are contemplated as being within the scope of the following claims particularly pointing out and distinctly claiming the subject matter regarded as the invention.

I claim:

1. An interment container, comprising:

an outer container comprising a lower container member and an upper container member that cooperate to define an interior; and an inner liner located within the interior of the outer container, wherein the inner liner comprises a lower liner section defining a lower peripheral flange and an upper liner section defining an upper peripheral flange, wherein the lower and upper flanges of the lower and upper liner sections, respectively, are sealed together and wherein the lower and upper liner sections cooperate to define a sealed internal cavity located within the interior of the outer container to prevent leakage or infiltration of fluids into and out of the internal cavity;

wherein the lower and upper flanges are formed of a thermoplastic material and are sealed together by means of a peripheral heating member located between the lower and upper flanges, wherein the heating member is adapted to be heated so as to impart heat to the thermoplastic material of the lower and upper flanges so as to liquefy the areas of the lower and upper flanges adjacent the heating member and to cause the material of the lower and upper flanges to flow together, wherein the liquefied material of the lower and upper flanges subsequently cools so as to solidify about the heating member and to form the seal between the lower and upper flanges;

wherein the lower container member includes an upper edge, and wherein the lower liner section includes a flange adapted to rest on the upper edge of the lower container member to support the lower liner section, and wherein the lower container member includes a bottom wall and wherein the lower liner section includes a bottom wall spaced above the bottom wall of the lower container member when the flange of the lower liner section rests on the upper edge of the lower container member.

2. An interment system, comprising:

vault comprising a lower vault member and an upper vault member that cooperate to define an interior;

an inner liner located within the interior of the vault, wherein the inner liner comprises a lower liner section defining a lower peripheral flange and an upper liner section defining an upper peripheral flange, wherein the lower and upper flanges of the lower and upper liner sections, respectively, are sealed together and wherein the lower and upper liner sections cooperate to define a sealed internal cavity located within the interior of the vault to prevent leakage or infiltration of fluids into and out of the internal cavity;

wherein the lower and upper flanges are formed of a thermoplastic material and are sealed together by means of a peripheral heating member located between the lower and upper flanges, wherein the heating member is adapted to be heated so as to impart heat to the thermoplastic material of the lower and upper flanges so as to liquefy the areas of the lower and upper flanges adjacent the heating member and to cause the material of the lower and upper flanges to flow together, wherein the liquefied material of the lower and upper flanges subsequently cools so as to solidify about the heating member and to form the seal between the lower and upper flanges; and a casket contained within the interior of the vault, wherein the casket contains the remains of a deceased and is enclosed by the liner, and wherein the sealed internal cavity defined by the upper and lower liner sections of the liner prevents leakage of fluids from the casket out of the internal cavity of the liner and infiltration of fluids into the casket from outside the internal cavity of the liner.

3. The interment system of claim 2, wherein the lower container member includes an upper edge, and wherein the lower liner section includes a flange adapted to rest on the upper edge of the lower container member to support the lower liner section.

4. The interment system of claim 2, wherein the peripheral heating member comprises a strip of electrically conductive and resistive material which is adapted for connection to a source of electrical current so as to impart heat to the strip in response to electrical current applied to the strip.

5. An interment container, comprising:

an outer container comprising a lower container member and an upper container member that cooperate to define an interior, wherein the upper container member includes first and second sections which are separately engageable with the lower container member and which together cooperate to enclose the lower container member;

an inner liner located within the interior of the outer container and including a transverse groove, wherein the inner liner comprises a lower liner section defining a lower peripheral flange and an upper liner section defining an upper peripheral flange, wherein the lower and upper flanges of the lower and upper liner sections, respectively, are sealed together and wherein the lower and upper liner sections cooperate to define a sealed internal cavity located within the interior of the outer container to prevent leakage or infiltration of fluids into and out of the internal cavity;

wherein the lower and upper flanges are formed of a thermoplastic material and are sealed together by means of a peripheral heating member located between the lower and upper flanges, wherein the heating member is adapted to be heated so as to impart heat to the thermoplastic material of the lower and upper flanges so as to liquefy the areas of the lower and upper flanges adjacent the heating member and to cause the material of the lower and upper flanges to flow together, wherein the liquefied material of the lower and upper flanges subsequently cools so as to solidify about the heating member and to form the seal between the lower and upper flanges.

6. An interment container, comprising:

an outer container comprising a lower container member and an upper container member that cooperate to define an interior; and an inner liner located within the interior of the outer container, wherein the inner liner comprises a lower liner section and an upper liner section, wherein the lower and upper liner sections are sealed together and cooperate to define a sealed internal cavity located within the interior of the outer container to prevent leakage or infiltration of fluids into and out of the internal cavity wherein the upper container member includes first and second sections which are separately engageable with the lower container member and which together cooperate to enclose the lower container member, wherein the first and second sections of the upper container member include end walls located adjacent each other when the first and second sections of the upper container member are in a closed position over the lower container member, and wherein the upper liner section includes a transverse groove within which the end walls are received.

7. In an interment arrangement wherein the remains of a deceased are adapted to be received within an interment container defining an internal cavity, the improvement comprising a sealed inner liner located within the internal cavity of the interment container, wherein the inner liner comprises a pair of liner sections peripherally sealed together to prevent leakage exteriorly of the interment container and to prevent infiltration into the liner, wherein the interment container includes a lower container member having a recess which at least in part defines the internal cavity of the interment container, in combination with an upper container member adapted to overlie the lower container member to enclose the recess of the lower container member to form the internal cavity, wherein the lower container member includes an upwardly facing peripheral edge, wherein a lower one of the pair of liner sections includes a peripheral lower flange engaged with and supported by the upwardly facing peripheral edge of the lower container member, and wherein an upper one of the pair of liner sections includes an upper flange engaged with and sealed to the lower flange of the lower liner section, wherein the upper and lower flanges are sealed together via a sealing member disposed between facing surfaces defined by the upper and lower flanges, wherein the upper and lower flanges are formed of a thermoplastic material and wherein the sealing member is adapted to be heated to a degree sufficient to liquefy portions of the upper and lower flanges adjacent the sealing member and to cause the liquefied portions of the upper and lower flanges to flow together about the sealing member, wherein subsequent cooling of the liquefied portions of the upper and lower flanges is operable to form an integral peripheral seal between the upper and lower flanges, and wherein the lower container member includes a bottom wall and wherein the lower liner section includes a bottom wall spaced above the bottom wall of the lower container member when the flange of the lower liner section rests on the upper edge of the lower container member.

8. The improvement of claim 7, wherein the interment container comprises a casket.

9. The improvement of claim 7, wherein the interment container comprises a burial vault adapted to receive a casket within the internal cavity.

10. In an interment arrangement wherein the remains of a deceased are placed within a casket and the casket is placed within a vault defining an internal cavity, the improvement comprising a sealed inner vault liner located within the internal cavity of the vault, wherein the inner vault liner defines an interior and comprises a pair of vault liner sections peripherally sealed together about the casket to enclose the casket within the interior of the inner vault liner and to prevent leakage exteriorly of the vault liner and infiltration into the interior of the inner vault liner, wherein the pair of vault liner sections define peripheral seal areas that define peripheral facing surfaces which are sealed together to peripherally seal the pair of vault liner sections together to enclose the casket within the vault liner, wherein a peripheral sealing member is located between the peripheral facing surfaces of the seal areas of the vault liner sections, wherein the peripheral seal areas are formed of a thermoplastic material and wherein the peripheral sealing member is adapted to be heated so as to liquefy portions of the seal areas and to cause the liquefied portions of the seal areas to flow together about the peripheral sealing member, wherein subsequent cooling of the liquefied portions of the seal areas is operable to form a peripheral integral seal about the inner vault liner.

11. An interment method, comprising the steps of:

providing an interment container including a lower member and an upper member adapted to overlie the lower member, wherein the lower member includes a recess such that the upper and lower members cooperate to form an internal cavity;

placing a lower liner section within the recess defined by the lower member of the interment container;

placing the remains of a deceased within the lower liner section;

peripherally sealing an upper liner section to the lower liner section to form a sealed liner construction located within the internal cavity of the interment container;

placing the upper section of the interment container over the lower section of the interment container, wherein the upper and lower sections of the interment container are operable to enclose the liner, wherein the peripheral seal of the liner is operable to prevent leakage of fluids from within the liner and infiltration of fluids into the liner;

wherein the step of peripherally sealing the upper liner section to the lower liner section is carried out by forming peripheral seal areas of the upper and lower liner sections of a thermoplastic material, imparting heat to the peripheral seal areas so as to liquefy portions of the peripheral seal areas, and subsequently cooling the peripheral seal areas such that the liquefied portions of the seal areas solidify so as to create a peripheral seal which is integral with the seal areas about the periphery of the upper and lower liner sections;

wherein the lower member of the interment container defines a peripheral upper edge, and wherein the step of placing the lower liner section within the recess defined by the lower member of the interment container is carried out by engaging a flange defined by the lower liner section with the upper edge of the lower container member; and wherein the step of placing the lower liner section within the recess defined by the lower member of the interment container is carried out such that a lower wall.

12. The interment method of claim 11, wherein the step of providing an interment container comprises providing a casket, wherein the remains of the deceased are placed within an interior defined by the casket.

13. The interment method of claim 11, wherein the step of providing an interment container comprises providing a burial vault and wherein the step of placing the remains of a deceased within the lower liner section is carried out by placing a casket containing the remains of the deceased within the recess defined by the lower member of the burial vault. defined by the lower liner section is spaced above a lower wall defined by the lower member of the interment container.

14. An interment method, comprising the acts of:

placing the remains of a deceased within a casket;

providing a vault including a lower member and an upper member adapted to overlie the lower member, wherein at least the lower member includes a recess such that the upper and lower members cooperate to form an internal cavity;

providing a lower liner section;

placing the casket into the lower liner section;

providing an upper liner section;

placing the upper liner section onto the lower liner section, wherein the upper and lower liner sections cooperate to define an interior within which the casket is contained;

peripherally sealing the upper liner section to the lower liner section to form a sealed liner construction and to contain the casket within the interior defined by the upper and lower liner sections;

positioning the sealed liner construction within the recess defined by the lower section of the vault; and placing the upper section of the vault over the lower section of the vault, wherein the upper and lower sections of the vault are operable to enclose the liner, wherein the peripheral seal of the liner is operable to prevent leakage of fluids from within the interior of the liner and infiltration of fluids into the interior of the liner;

wherein the step of peripherally sealing the upper liner section to the lower liner section is carried out by forming peripheral seal areas of the upper and lower liner sections of a thermoplastic material, imparting heat to the peripheral seal areas so as to liquefy portions of the peripheral seal areas, and subsequently cooling the peripheral seal areas such that the liquefied portions of the seal areas solidify so as to create a peripheral seal which is integral with the seal areas about the periphery of the upper and lower liner sections.

15. The method of claim 14, wherein the step of peripherally sealing the upper liner section to the lower liner section is carried out by peripherally sealing an upper flange defined by the upper liner section to a lower flange defined by the lower liner section.

16. The method of claim 14, wherein the step of imparting heat to the seal areas is carried out by applying an electrical current to a peripheral sealing member located between the peripheral seal areas of the upper and lower liner sections, wherein the peripheral sealing member is formed of an electrically conductive and resistive material, wherein the resistance of the peripheral sealing member material functions to heat the peripheral sealing member to heat the adjacent portions of the seal areas an amount sufficient to liquefy the material of the seal areas and to cause the material of the seal areas to flow together about the peripheral sealing member.

17. An interment method, comprising the steps of:

providing an interment container including a lower member and an upper member adapted to overlie the lower member, wherein the lower member includes a recess such that the upper and lower members cooperate to form an internal cavity;

placing a lower liner section within the recess defined by the lower member of the interment container;

placing the remains of a deceased within the lower liner section;

peripherally sealing an upper liner section to the lower liner section to form a sealed liner construction located within the internal cavity of the interment container; and placing the upper section of the interment container over the lower section of the interment container, wherein the upper and lower sections of the interment container are operable to enclose the liner, wherein the peripheral seal of the liner is operable to prevent leakage of fluids from within the liner and infiltration of fluids into the liner;

wherein the upper member of the interment container includes first and second sections having adjacent end walls, each of which extends inwardly from an outer wall, and wherein the step of placing the upper member of the interment container over the lower member is carried out by positioning the adjacent end walls of the first and second sections into a transverse groove formed in the upper liner member.

* * * * *

UNITED STATES PATENT AND TRADEMARK OFFICE

CERTIFICATE OF CORRECTION

PATENT NO. : 6,901,640 B2
DATED : June 7, 2005
INVENTOR(S) : Douglas L. Sevey

It is certified that error appears in the above-identified patent and that said Letters Patent is hereby corrected as shown below:

Column 9,
Line 35, before "vault" insert -- a --;

Column 10,
Line 20, after "container" delete "and including a transverse groove";
Line 23, after "flange" and before "," insert -- and including a transverse groove --;

Column 12,
Line 37, after "wall" insert -- defined by the lower liner section is spaced above a lower wall defined by the lower member of the interment container --;

Column 13,
Lines 48-50, after "vault" delete "defined by the lower liner section is spaced above a lower wall defined by the lower member of the interment container".

Signed and Sealed this

Eleventh Day of October, 2005

JON W. DUDAS
*Director of the United States Patent and Trademark Office*